US009406437B2

(12) United States Patent
Omura et al.

(10) Patent No.: US 9,406,437 B2
(45) Date of Patent: Aug. 2, 2016

(54) GRAIN ORIENTED ELECTRICAL STEEL SHEET AND METHOD FOR MANUFACTURING THE SAME

(75) Inventors: Takeshi Omura, Tokyo (JP); Hirotaka Inoue, Tokyo (JP); Hiroi Yamaguchi, Tokyo (JP); Seiji Okabe, Tokyo (JP)

(73) Assignee: JFE Steel Corporation (JP)

( * ) Notice: Subject to any disclaimer, the term of this patent is extended or adjusted under 35 U.S.C. 154(b) by 707 days.

(21) Appl. No.: 13/814,532

(22) PCT Filed: Aug. 5, 2011

(86) PCT No.: PCT/JP2011/004473

§ 371 (c)(1),
(2), (4) Date: Feb. 6, 2013

(87) PCT Pub. No.: WO2012/017690

PCT Pub. Date: Feb. 9, 2012

(65) Prior Publication Data

US 2013/0129984 A1 May 23, 2013

(30) Foreign Application Priority Data

Aug. 6, 2010 (JP) ..... 2010-178026

(51) Int. Cl.
*H01F 41/00* (2006.01)
*C22C 38/00* (2006.01)
(Continued)

(52) U.S. Cl.
CPC ..... *H01F 41/00* (2013.01); *C21D 8/1255* (2013.01); *C21D 8/1283* (2013.01); *C22C 38/00* (2013.01);
(Continued)

(58) Field of Classification Search
CPC ..... C22C 38/00–38/60; Y10T 428/2457; Y10T 428/24612
See application file for complete search history.

(56) References Cited

U.S. PATENT DOCUMENTS 4,293,350 A 10/1981 Ichiyama et al.
4,318,758 A * 3/1982 Kuroki ..... H01F 1/14775 148/111
(Continued)

FOREIGN PATENT DOCUMENTS

CN 101541991 A 9/2009
JP 57-2252 1/1982
(Continued)

OTHER PUBLICATIONS

Chinese Office Action Summary dated Sep. 5, 2014 along with an English translation for corresponding Chinese Application No. 201180038847.3.
(Continued)

*Primary Examiner* — Donald J Loney
(74) *Attorney, Agent, or Firm* — DLA Piper LLP (US)

(57) ABSTRACT

A grain oriented electrical steel sheet has thickness of forsterite film at bottom portions of grooves formed on a surface of the steel sheet is ≥0.3 μm, groove frequency is ≤20%, abundance ratio of grooves crystal grains directly beneath themselves, each crystal grain having orientation deviating from Goss orientation by ≥10° and grain size ≥5 μm, total tension exerted on the steel sheet in the rolling direction by the forsterite film and tension coating is ≥10.0 MPa, total tension exerted on the steel sheet in a direction perpendicular to the rolling direction by the forsterite film and tension coating is ≥5.0 MPa and total tension satisfies 1.0≤A/B≤5.0, where A is total tension exerted in rolling direction by forsterite film and tension coating, and B is total tension exerted in direction perpendicular to rolling direction by forsterite film and tension coating.

1 Claim, 1 Drawing Sheet

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/34*** | (2006.01) |
| ***H01F 1/18*** | (2006.01) |
| ***C21D 8/12*** | (2006.01) |
| *B21B 3/02* | (2006.01) |

(52) U.S. Cl.

CPC ..... *C22C 38/001* (2013.01); *C22C 38/04* (2013.01); *C22C 38/06* (2013.01); *C22C 38/08* (2013.01); *C22C 38/34* (2013.01); *H01F 1/18* (2013.01); *B21B 3/02* (2013.01); *Y10T 428/2457* (2015.01); *Y10T 428/24612* (2015.01)

(56) References Cited

U.S. PATENT DOCUMENTS

| | | | | |
|---|---|---|---|---|
| 4,770,720 | A | 9/1988 | Kobayashi et al. | |
| 2002/0000261 | A1* | 1/2002 | Fujikura ..... | C21D 8/1288 148/121 |
| 2002/0157734 | A1* | 10/2002 | Senda ..... | C21D 8/1266 148/111 |

FOREIGN PATENT DOCUMENTS

| | | | |
|---|---|---|---|
| JP | 62-53579 | | 11/1987 |
| JP | 2-125815 | A | 5/1990 |
| JP | 7-268474 | A | 10/1995 |
| JP | 9-157748 | A | 6/1997 |
| JP | 2001-303137 | A | 10/2001 |
| JP | 2001-303261 | A | 10/2001 |
| JP | 2002-241906 | * | 8/2002 |
| JP | 2002-356750 | A | 12/2002 |
| JP | 2003-166018 | A | 6/2003 |

OTHER PUBLICATIONS

Japanese Notification of Reasons for Refusal dispatched Aug. 19, 2014 along with an English translation for corresponding Japanese Patent Application No. 2010-178026.

Russian Official Action dated Apr. 17, 2014 along with an English translation from corresponding Russian Application No. 2013109940.

Chinese Office Action mailed Jun. 3, 2014 for Chinese Application No. 201180038847.3 along with an English translation.

Canadian Office Action mailed May 21, 2014 for Canadian Application No. 2,807,447.

* cited by examiner

GRAIN ORIENTED ELECTRICAL STEEL SHEET AND METHOD FOR MANUFACTURING THE SAME

RELATED APPLICATIONS

This is a §371 of International Application No. PCT/JP2011/004473, with an international filing date of Aug. 5, 2011 (WO 2012/017690 A1, published Feb. 9, 2012), which is based on Japanese Patent Application No. 2010-178026, filed Aug. 6, 2010, the subject matter of which is incorporated herein by reference.

TECHNICAL FIELD

This disclosure relates to a grain oriented electrical steel sheet used for iron core materials such as transformers, and a method for manufacturing the same.

BACKGROUND

Grain oriented electrical steel sheets-mainly used as iron cores of transformers are required to have excellent magnetic properties, in particular, less iron loss. To meet this requirement, it is important that secondary recrystallized grains are highly aligned in the steel sheet in the (110)[001] orientation (or so-called Goss orientation) and impurities in the product steel sheet are reduced. However, there are limitations in controlling crystal orientation and reducing impurities in terms of balancing with manufacturing cost, and so on. Therefore, some techniques have been developed to introduce non-uniform strain to the surfaces of a steel sheet in a physical manner and reduce the magnetic domain width for less iron loss, namely, magnetic domain refining techniques.

For example, JP 57-002252 B proposes a technique for reducing iron loss of a steel sheet by irradiating a final product steel sheet with a laser, introducing a high dislocation density region to the surface layer of the steel sheet and reducing the magnetic domain width. In addition, JP 62-053579 B proposes a technique for refining magnetic domains by forming grooves having a depth of more than 5 μm on the base iron portion of a steel sheet after final annealing at a load of 882 to 2156 MPa (90 to 220 kgf/mm$^2$), and then subjecting the steel sheet to heat treatment at a temperature of 750° C. or higher. Further, JP 7-268474 A discloses a technique for providing a steel sheet that has linear grooves extending in a direction almost orthogonal to the rolling direction of steel sheet on a surface of the iron base, and also has continuous crystalline grain boundaries or fine crystalline grain regions of 1 mm or less grain size from the bottom of the linear grooves to the other surface of the base iron in the sheet thickness direction. With the development of the above-described magnetic domain refining techniques, grain oriented electrical steel sheets having good iron loss properties may be obtained.

However, the above-mentioned techniques for performing magnetic domain refining treatment by forming grooves have a smaller effect on reducing iron loss compared to other magnetic domain refining techniques for introducing high dislocation density regions by laser irradiation and so on. The above-mentioned techniques also have a problem that there is little improvement in iron loss of an actual transformer assembled, even though iron loss is reduced by magnetic domain refinement. That is, these techniques provide an extremely poor building factor (BF).

It could therefore be helpful to provide a grain oriented electrical steel sheet that may further reduce iron loss of a material with grooves formed thereon for magnetic domain refinement and exhibit excellent low iron loss properties when assembled as an actual transformer, along with an advantageous method for manufacturing the same.

SUMMARY

We thus provide:

[1] A grain oriented electrical steel sheet comprising: a forsterite film and tension coating on a surface of the steel sheet; and grooves for magnetic domain refinement on the surface of the steel sheet, wherein a thickness of the forsterite film at the bottom portions of the grooves is 0.3 μm or more, wherein a groove frequency is 20% or less, the groove frequency being an abundance ratio of grooves, each groove having crystal grains directly beneath itself, each crystal grain having an orientation deviating from the Goss orientation by 10° or more and a grain size of 5 μm or more, and wherein a total tension exerted on the steel sheet in a rolling direction by the forsterite film and the tension coating is 10.0 MPa or more, a total tension exerted on the steel sheet in a direction perpendicular to the rolling direction by the forsterite film and the tension coating is 5.0 MPa or more, and these total tensions satisfy a relation:

$$1.0 \leq A/B \leq 5.0,$$

where

A is a total tension exerted in the rolling direction by the forsterite film and the tension coating, and B is a total tension exerted in the direction perpendicular to the rolling direction by the forsterite film and the tension coating.

[2] A method for manufacturing a grain oriented electrical steel sheet, the method comprising: subjecting a slab for a grain oriented electrical steel sheet to rolling to be finished to a final sheet thickness; subjecting the sheet to subsequent decarburization; then applying an annealing separator composed mainly of MgO to a surface of the sheet before subjecting the sheet to final annealing; and subjecting the sheet to subsequent tension coating, wherein (1) formation of grooves for magnetic domain refinement is performed before the final annealing for forming a forsterite film, (2) the annealing separator has a coating amount of 10.0 g/m$^2$ or more, (3) coiling tension after the application of the annealing separator is controlled within a range of 30 to 150 N/mm$^2$, (4) an average cooling rate to 700° C. during a cooling step of the final annealing is controlled to be 50° C./h or lower, (5) during the final annealing, flow rate of atmospheric gas at a temperature range of at least 900° C. or higher is controlled to be 1.5 Nm$^3$/h·ton or less, and (6) an end-point temperature during the final annealing is controlled to be 1150° C. or higher.

[3] The method for manufacturing a grain oriented electrical steel sheet according to item [2] above, wherein the slab for the grain oriented electrical steel sheet is subjected to hot rolling, and optionally, hot band annealing, and subsequently subjected to cold rolling once, or twice or more with intermediate annealing performed therebetween, to be finished to a final sheet thickness.

Since the iron loss reduction effect of a steel sheet, which has grooves formed thereon and is subjected to magnetic domain refining treatment, is also to be maintained in an actual transformer effectively, such a grain oriented electrical steel sheet may be obtained that demonstrate excellent low iron loss properties in an actual transformer.

BRIEF DESCRIPTION OF THE DRAWINGS

Our steel sheets and methods will be further described below with reference to the accompanying drawings, wherein.

DETAILED DESCRIPTION

Figure 1:
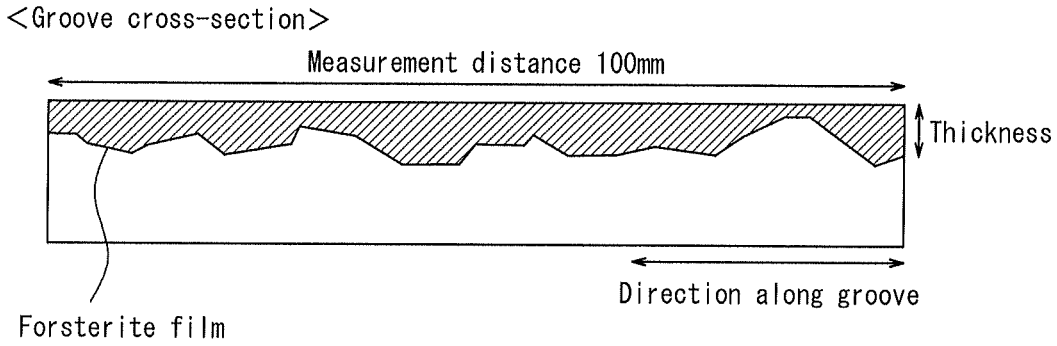
FIG. 1 is a cross-sectional view of a groove portion of a steel sheet.

To improve the iron loss properties of a grain oriented electrical steel sheet as a material with grooves formed thereon for magnetic domain refinement and having a forsterite film (a film composed mainly of $Mg_2SiO_4$), and to prevent the deterioration in the building factor in an actual transformer using that grain oriented electrical steel sheet, the thickness of the forsterite film formed on the bottom portions of grooves, tension exerted on the steel sheet and crystal grains directly beneath the grooves are defined as follows.

Thickness of the forsterite film at the bottom portions of grooves: 0.3 μm or more.

The effect attained by introducing grooves through magnetic domain refinement to form grooves is smaller than the effect obtained by the magnetic domain refining technique to introduce a high dislocation density region, because a smaller magnetic charge is introduced. First, we investigated the magnetic charge introduced when grooves were formed. As a result, we found a correlation between the thickness of the forsterite film where grooves were formed and the magnetic charge. Then, we further investigated the relationship between the thickness of the film and the magnetic charge. As a result, it was revealed that increasing the thickness of the film where grooves were formed is effective in increasing the magnetic charge.

Consequently, the thickness of the forsterite film necessary to increase the magnetic charge and improve the magnetic domain refining effect is 0.3 μm or more, preferably 0.6 μm or more. On the other hand, the upper limit of the thickness of the forsterite film is preferably about 5.0 μm, because adhesion with the steel sheet deteriorates and the forsterite film comes off more easily if the forsterite film is too thick.

While the cause of an increase in the magnetic charge as described above has not been clarified exactly, we believe as follows. There is a correlation between the thickness of the film and tension exerted on the steel sheet by the film, where the tension exerted by the film at the bottom portions of grooves becomes larger with increasing film thickness. We believe that this increased tension causes an increase in internal stress of the steel sheet at the bottom portions of grooves, which result in an increase in the magnetic charge.

When evaluating iron loss of a grain oriented electrical steel sheet as a product, the magnetizing flux only contains rolling directional components and, therefore, it is only necessary to increase tension in the rolling direction to improve iron loss. However, when a grain oriented electrical steel sheet is assembled as an actual transformer, the magnetizing flux contains not only rolling directional components, but also transverse directional components. Accordingly, tension in the rolling direction as well as tension in the transverse direction has an influence on iron loss.

Therefore, a tension ratio is determined by a ratio of the rolling directional components to the transverse directional components of the magnetizing flux. Specifically, a tension ratio satisfies Formula (1):

$$1.0 \leq A/B \leq 5.0 \quad (1),$$

preferably, $1.0 \leq A/B \leq 3.0$, where

A is a total tension exerted in the rolling direction by the forsterite film and the tension coating, and B is a total tension exerted in the transverse direction by the forsterite film and the tension coating.

Further, even if the above-described condition is satisfied, degradation in iron loss is unavoidable when the absolute value of the tension exerted on the steel sheet is small. In view of the foregoing, as a result of further investigations on preferred values of tension in the rolling direction and in the transverse direction, we found that in the transverse direction, a total tension exerted by the forsterite film and tension coating is assumed to be sufficient if it is 5.0 MPa or more, whereas in the rolling direction, a total tension exerted by the forsterite film and tension coating should be 10.0 MPa or more. It should be noted that there is no particular upper limit on the total tension "A" in the rolling direction as long as the steel sheet does not plastically deform. A preferable upper limit of the total tension "A" is 200 MPa or less.

The total tension exerted by the forsterite film and the tension coating is determined as follows. When measuring the tension in the rolling direction, a sample of 280 mm in the rolling direction×30 mm in the transverse direction is cut from the product (tension coating-applied material), whereas when measuring the tension in the transverse direction, a sample of 280 mm in the transverse direction×30 mm in the rolling direction is cut from the product. Then, the forsterite film and the tension coating on one side is removed. Then, the steel sheet warpage is determined by measuring warpage before and after the removal and converted to tension using conversion formula (2). The tension determined by this method represents the tension exerted on the surface from which the forsterite film and the tension coating have not been removed. Since tension is exerted on both sides of the sample, two samples were prepared for measuring the same product in the same direction, and tension was determined for each side by the above-described method to derive an average value of the tension. This average value is considered as the tension being exerted on the sample.

$$\sigma = \frac{Ed}{l^2}(a_2 - a_1) \quad \text{Conversion Formula (2)}$$

where, σ: film tension (MPa)

E: Young's modulus of steel sheet=143 (GPa)

L: warpage measurement length (mm)

$a_1$: warpage before removal (mm)

$a_2$: warpage after removal (mm)

d: steel sheet thickness (mm)

The thickness of the forsterite film at the bottom portions of grooves is calculated as follows. As illustrated in FIG. 1, the forsterite film at the bottom portions of grooves was observed with SEM in a cross-section taken along the direction in which grooves extend, where the area of the forsterite film was calculated by image analysis and the calculated area was divided by a measurement distance to determine the thickness of the forsterite film of the steel sheet. In this case, the measurement distance was 100 mm.

Groove Frequency: 20% or Less

Groove frequency is important wherein there is an abundance ratio of grooves, each groove having crystal grains directly beneath itself, each crystal grain having an orientation deviating from the Goss orientation by 10° or more and a grain size of 5 μm or more. It is important that this groove frequency is 20% or less.

In the following, the groove frequency will be explained specifically. To improve the building factor, it is important to define the tension of the forsterite film as described above, as well as to leave as few crystal grains largely deviating from the Goss orientation as possible directly beneath the portions where grooves are formed. It should be noted here that JP 62-053579 B and JP 7-268474 A state that material iron loss improves more where fine grains are present directly beneath grooves.

However, when actual transformers were manufactured using two types of materials, one with fine grains present directly beneath grooves and the other without fine grains directly beneath grooves, the latter material gave better results than the former in that the actual transformer exhibited better iron loss, i.e., the building factor was better, although inferior in material iron loss.

In view of this, we investigated materials with fine grains directly beneath grooves formed therein. As a result, we found that the value of groove frequency, which is a ratio of those grooves with crystal grains directly beneath themselves to those grooves without crystal grains directly beneath themselves, is important. Each material having a groove frequency of 20% or less showed a good building factor, although specific calculation of groove frequency will be described later. Thus, the groove frequency is 20% or less.

As described above, although the reason why the results of iron loss of a material and the results of iron loss of an actual transformer do not always show a consistent tendency has not been clarified, we believe that it can be ascribed to a difference between a magnetizing flux waveform of the actual transformer and a magnetizing flux waveform for use in evaluating the material. Accordingly, while fine grains directly beneath grooves have an effect on improving material iron loss, it is necessary to reduce such fine grains directly beneath grooves as much as possible considering the use in actual transformers because they would otherwise cause an adverse effect of deterioration in building factor.

However, ultrafine grains sized less than 5 μm, as well as fine grains sized 5 μm or more, but having a good crystal orientation deviating from the Goss orientation by less than 10°, have neither adverse nor positive effects. Hence, there is no problem if these grains are present. Accordingly, as used herein, a fine grain is defined as a crystal grain having an orientation deviating from the Goss direction by 10° or more, a grain size of 5 μm or more, and is subjected to derivation of groove frequency. In addition, the upper limit of grain size is about 300 μm. This is because if the grain size exceeds this limit, material iron loss deteriorates and, therefore, lowering the frequency of grooves having fine grains to some extent does not have much of an effect on improving iron loss of an actual transformer.

Figure 2:
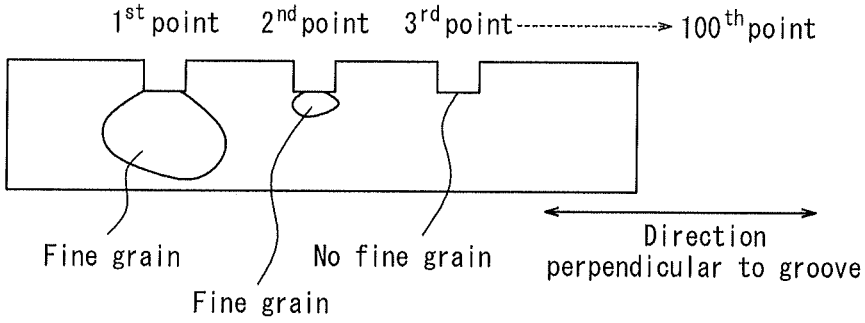
FIG. 2 is a cross-sectional view of a steel sheet taken in a direction orthogonal to groove portions.

The crystal grain size of crystal grains present directly beneath grooves, crystal orientation difference and groove frequency are determined as follows. As illustrated in FIG. 2, the crystal grain size of crystal grains is determined as follows: a cross-section is observed at 100 points in a direction perpendicular to groove portions and, if there is a crystal grain, the crystal grain size thereof is calculated as an equivalent circle diameter. In addition, crystal orientation difference is determined as a deviation angle from the Goss orientation by using EBSP (Electron BackScattering Pattern) to measure the crystal orientation of crystals at the bottom portions of grooves. Further, groove frequency means a ratio of the number of those grooves in the presence of crystal grains in the above-described 100 measurement points divided by the number of measurement points, 100.

Next, the conditions of manufacturing a grain oriented electrical steel sheet will be specifically described below. A slab for a grain oriented electrical steel sheet may have any chemical composition that allows for secondary recrystallization. In addition, the higher the degree of the crystal grain alignment in the <100> direction, the greater the effect of reducing iron loss obtained by magnetic domain refinement. It is thus preferable that a magnetic flux density $B_8$, which gives an indication of the degree of the crystal grain alignment, is 1.90 T or higher.

In addition, if an inhibitor, e.g., an AlN-based inhibitor is used, Al and N may be contained in an appropriate amount, respectively, while if a MnS/MnSe-based inhibitor is used, Mn and Se and/or S may be contained in an appropriate amount, respectively. Of course, these inhibitors may also be used in combination. In this case, preferred contents of Al, N, S and Se are: Al: 0.01 to 0.065 mass %; N: 0.005 to 0.012 mass %; S: 0.005 to 0.03 mass %; and Se: 0.005 to 0.03 mass %, respectively.

Further, our grain oriented electrical steel sheet may have limited contents of Al, N, S and Se without using an inhibitor. In this case, the amounts of Al, N, S and Se are preferably: Al: 100 mass ppm or less: N: 50 mass ppm or less; S: 50 mass ppm or less; and Se: 50 mass ppm or less, respectively.

The basic elements and other optionally added elements of the slab for a grain oriented electrical steel sheet will be specifically described below.

<C: 0.08 Mass % or Less>

C is added to improve the texture of a hot-rolled sheet. However, C content exceeding 0.08 mass % increases the burden to reduce C content to 50 mass ppm or less where magnetic aging will not occur during the manufacturing process. Thus, C content is preferably 0.08 mass % or less. Besides, it is not necessary to set up a particular lower limit to C content because secondary recrystallization is enabled by a material not containing C.

<Si: 2.0 to 8.0 Mass %>

Si is an element useful to increase electrical resistance of steel and improve iron loss. Si content of 2.0 mass % or more has a particularly good effect in reducing iron loss. On the other hand, Si content of 8.0 mass % or less may offer particularly good formability and magnetic flux density. Thus, Si content is preferably 2.0 to 8.0 mass %.

<Mn: 0.005 to 1.0 Mass %>

Mn is an element advantageous to improve hot formability. However, Mn content less than 0.005 mass % has a less addition effect. On the other hand, Mn content of 1.0 mass % or less provides a particularly good magnetic flux density to the product sheet. Thus, Mn content is preferably 0.005 to 1.0 mass %.

Further, in addition to the above elements, the slab may also contain the following elements as elements to improve magnetic properties:

at least one element selected from: Ni: 0.03 to 1.50 mass %; Sn: 0.01 to 1.50 mass %; Sb: 0.005 to 1.50 mass %; Cu: 0.03 to 3.0 mass %; P: 0.03 to 0.50 mass %; Mo: 0.005 to 0.10 mass %; and Cr: 0.03 to 1.50 mass %.

Ni is an element useful to further improve the texture of a hot-rolled sheet to obtain even more improved magnetic properties. However, Ni content of less than 0.03 mass % is less effective in improving magnetic properties, whereas Ni content of 1.50 mass % or less increases, in particular, the stability of secondary recrystallization and provides even more improved magnetic properties. Thus, Ni content is preferably 0.03 to 1.50 mass %.

Sn, Sb, Cu, P, Mo and Cr are elements useful to further improve the magnetic properties, respectively. However, if any of these elements is contained in an amount less than its lower limit described above, it is less effective in improving the magnetic properties, whereas if contained in an amount equal to or less than its upper limit as described above, it gives the best growth of secondary recrystallized grains. Thus, each of these elements is preferably contained in an amount within the above-described range. The balance other than the above-described elements is Fe and incidental impurities incorporated during the manufacturing process.

Then, the slab having the above-described chemical composition is subjected to heating before hot rolling in a conventional manner. However, the slab may also be subjected to hot rolling directly after casting, without being subjected to heating. In the case of a thin slab, it may be subjected to hot rolling or proceed to the subsequent step, omitting hot rolling.

Further, the hot rolled sheet is optionally subjected to hot band annealing. A main purpose of hot band annealing is to improve the magnetic properties by dissolving the band texture generated by hot rolling to obtain a primary recrystallization texture of uniformly-sized grains, and thereby further developing a Goss texture during secondary recrystallization annealing. As this moment, to obtain a highly-developed Goss texture in a product sheet, the hot band annealing temperature is preferably 800° C. to 1100° C. If the hot band annealing temperature is lower than 800° C., there remains a band texture resulting from hot rolling, which makes it difficult to obtain a primary recrystallization texture of uniformly-sized grains and impedes the desired improvement of secondary recrystallization. On the other hand, if the hot band annealing temperature exceeds 1100° C., the grain size after the hot band annealing coarsens too much, which makes it difficult to obtain a primary recrystallization texture of uniformly-sized grains.

After hot band annealing, the sheet is subjected to cold rolling once, or twice or more with intermediate annealing performed therebetween, followed by decarburization (combined with recrystallization annealing) and application of an annealing separator to the sheet. After application of the annealing separator, the sheet is subjected to final annealing for purposes of secondary recrystallization and formation of a forsterite film. It should be noted that the annealing separator is preferably composed mainly of MgO to form forsterite. As used herein, the phrase "composed mainly of MgO" implies that any well-known compound for the annealing separator and any property improvement compound other than MgO may also be contained within a range without interfering with formation of a forsterite film. In addition, as described later, formation of grooves is performed in any step after final cold rolling and before final annealing.

After final annealing, it is effective to subject the sheet to flattening annealing to correct the shape thereof. An insulation coating is applied to the surfaces of the steel sheet before or after flattening annealing. As used herein, this insulation coating means such coating that may apply tension to the steel sheet to reduce iron loss (hereinafter, referred to as tension coating). Tension coating includes inorganic coating containing silica and ceramic coating by physical vapor deposition, chemical vapor deposition, and so on.

It is important to appropriately adjust tension to be exerted on the steel sheet in the rolling and transverse directions. In this case, tension in the rolling direction may be controlled by adjusting the amount of tension coating to be applied. That is, tension coating is usually performed in a baking furnace where a steel sheet is applied with a coating liquid and baked, while being stretched in the rolling direction. Accordingly, in the rolling direction, the steel sheet is baked with a coating material while being stretched and thermally expanded. When the steel sheet is unloaded and cooled after the baking, it shrinks more than the coating material due to the shrinkage caused by unloading and the difference in thermal expansion coefficient between the steel sheet and the coating material, which leads to a state where the coating material keeps a pulling force on the steel sheet and thereby applies tension to the steel sheet.

On the other hand, in the transverse direction, the steel sheet is not be subjected to stretching in the baking furnace, but rather, stretched in the rolling direction, which leads to a state where the steel sheet is compressed in the transverse direction. Accordingly, such compression compensates elongation of the steel sheet due to thermal expansion. Thus, it is difficult to increase tension applied in the transverse direction by the tension coating.

In view of the above, the following control items are provided as manufacturing conditions to improve the tension of the forsterite film in the transverse direction:

(a) the annealing separator has a coating amount of 10.0 $g/m^2$ or more, (b) coiling tension after application of the annealing separator is controlled to 30 to 150 $N/mm^2$, (c) an average cooling rate to 700° C. during a cooling step of the final annealing is to 50° C./h or lower.

Since the steel sheet is subjected to final annealing in the coiled form, there are large temperature variations during cooling. As a result, the amount of thermal expansion in the steel sheet likely varies with location. Accordingly, stress is exerted on the steel sheet in various directions. That is, when the steel sheet is coiled tight, large stress is exerted on the steel sheet since there is no gap between surfaces of adjacent turns of the steel sheet, and damages the film. Accordingly, it is effective in avoiding damage to the film to reduce stress generated in the steel sheet by leaving some gaps between surfaces of adjacent turns of the steel sheet and decrease the cooling rate and thereby reduce temperature variations in the coil.

Hereinbelow, reference will be made to the mechanism for reduction in the damage to the film by the control of the above-listed items (a) to (c). Since an annealing separator releases moisture or $CO_2$ during annealing, it shows a decrease in volume over time after the application. It will be appreciated that a decrease in volume indicates the occurrence of gaps in that portion, which is effective for stress relaxation. In this case, if the annealing separator has a small coating amount, this will result in insufficient gaps. Therefore, the coating amount of the annealing separator is to be limited to 10.0 $g/m^2$ or more. In addition, there is no particular upper limit to the coating amount of the annealing separator, without interfering with the manufacturing process (such as causing weaving of the coil during the final annealing). If any inconvenience such as the above-described weaving is caused, it is preferable that the coating amount is 50 $g/m^2$ or less.

In addition, as the coiling tension is reduced, more gaps are created between surfaces of adjacent turns of the steel sheet than in the case where the steel sheet is coiled with a higher tension. These results in less stress generated. However, an excessively low coiling tension also has a problem in that it causes uncoiling of the coil. Accordingly, coiling tension is defined as 30 to 150 $N/mm^2$ as a condition under which any stress caused by temperature variations during cooling can be relaxed and uncoiling will not occur.

Further, if the cooling rate during final annealing is lowered, temperature variations are reduced in the steel sheet and, therefore, stress in the coil is relaxed. A slower cooling rate is better from the viewpoint of stress relaxation, but less favorable in terms of production efficiency. It is thus preferable that the cooling rate is 5° C./h or higher. By virtue of a combination of controlling the coating amount of the annealing separator and coiling tension, a cooling rate up to 50° C./h is acceptable as an upper limit. In this way, stress is relaxed by controlling each of the coating amount of the annealing separator, the coiling tension and the cooling rate. As a result, it is possible to improve the tension of the forsterite film in the transverse direction.

It is important to form the forsterite film at the bottom portions of the grooves with a thickness over a certain level. To form the forsterite film at the bottom portions of the grooves, it is necessary to form the grooves before forming the forsterite film for the following reason. If the forsterite film is formed before the grooves are formed using pressing means such as gear-type rolls, then unnecessary strain is introduced to the surfaces of the steel sheet. This necessitates high temperature annealing to remove the strain introduced by pressing after formation of the grooves. When such high temperature annealing is performed, fine grains form directly beneath the grooves. However, it is extremely difficult to control the crystal orientation of such fine grains, causing deterioration in iron loss properties of an actual transformer. In such a case, further annealing such as final annealing may be performed at high temperature and for a long period of time to eliminate the above-described fine grains. However, such an additional process leads to a reduction in productivity and an increase in cost.

In addition, if final annealing is performed and the forsterite film is formed before grooves are formed by chemical polishing such as electrolysis etching, then the forsterite film is removed during chemical polishing. Accordingly, the forsterite film needs to be formed again to satisfy the amount of the forsterite film at the bottom portions of the grooves, which also leads to increased cost.

To form the forsterite film at the bottom portions of the grooves with a predetermined thickness, it is important that during final annealing, flow rate of atmospheric gas at a temperature range of at least 900° C. or higher is controlled to 1.5 $Nm^3$/h·ton or less. This is because the atmospheric circulation ability is very high at the groove portions as compared to the interlayer portions other than the groove portions since large gaps are left at the groove portions even if the steel sheet is coiled tightly. However, an excessively high atmosphere circulation ability causes difficulty for gas such as oxygen released from the annealing separator during final annealing to be retained between interlayer portions. This causes a reduction in the amount of additional oxidation of the steel sheet during final annealing, which results in a disadvantage that the forsterite film becomes thinner. It should be noted that the atmospheric circulation ability is low at the interlayer portions other than the bottom portions, which interlayer portions are thus less susceptible to the flow rate of atmospheric gas. Thus, there is no problem if the flow rate of atmospheric gas is limited as described above. Although there is no particular limit on the lower limit of the flow rate of atmospheric gas, in general, the lower limit of the flow rate of atmospheric gas is 0.01 $Nm^3$/h·ton or more.

Grooves are formed on a surface of the grain oriented electrical steel sheet in any step after the above-described final cold rolling and before final annealing. In this case, by controlling the thickness of the forsterite film at the bottom portions of the grooves and the groove frequency, and controlling the total tension of the forsterite film and the tension coating in the rolling direction and the transverse direction as described above, an improvement in iron loss is achieved more effectively by a magnetic domain refining effect obtained by forming grooves and a sufficient magnetic domain refining effect is obtained.

In this case, during final annealing, a size effect provides a driving force for secondary recrystallization such that primary recrystallized grains are encroached by secondary recrystallized grains. However, if the primary recrystallization coarsens due to normal grain growth, the difference in grain size between the secondary recrystallized grains and the primary recrystallized grains is reduced. Accordingly, the size effect is reduced so that the primary recrystallized grains become less prone to encroachment, and some primary recrystallized grains remain as-is. The resulting grains are fine grains with poor crystal orientation. Any strain introduced at the periphery of grooves during formation of the grooves makes primary recrystallized grains prone to coarsening, and thus fine grains remain more frequently. To decrease the frequency of occurrence of fine grains with poor crystal orientation as well as the frequency of occurrence of grooves with such fine grains, it is necessary to control an end-point temperature during the final annealing to be 1150° C. or higher.

Further, by controlling the end-point temperature to be 1150° C. or higher to increase the driving force for the growth of secondary recrystallized grains, encroachment of the coarsened primary recrystallized grains is enabled regardless of the presence or absence of strain at the periphery of grooves. In addition, if strain formation is performed by a chemical scheme such as electrolysis etching without introducing strain, rather than a mechanical scheme using rolls with projections or the like, then coarsening of primary recrystallized grains may be suppressed and the frequency of occurrence of residual fine grains may be decreased in an efficient manner. As groove formation means, a chemical scheme such as electrolysis etching is more preferable.

It is desirable that the shape of each groove is in linear form, although not limited to a particular form as long as the magnetic domain width can be reduced. Grooves are formed by different methods including conventionally well-known methods for forming grooves, e.g., a local etching method, scribing method using cutters or the like, rolling method using rolls with projections, and so on. The most preferable method is a method including adhering, by printing or the like, etching resist to a steel sheet after being subjected to final cold rolling, and then forming grooves on a non-adhesion region of the steel sheet through a process such as electrolysis etching.

In the case of linear grooves formed on a surface of the steel sheet, it is preferable that each groove has a width of about 50 to 300 μm, depth of about 10 to 50 μm and groove interval of about 1.5 to 10.0 mm, and that each linear groove deviates from a direction perpendicular to the rolling direction within a range of ±30°. As used herein, "linear" is intended to encompass a solid line as well as a dotted line, dashed line, and so on.

Except the above-mentioned steps and manufacturing conditions, a conventionally well-known method for manufacturing a grain oriented electrical steel sheet may be applied where magnetic domain refining treatment is performed by forming grooves.

EXAMPLES

Example 1

Steel slabs, each having the chemical composition as shown in Table 1, were manufactured by continuous casting.

Each of these steel slabs was heated to 1400° C., subjected to hot rolling to be finished to a hot-rolled sheet having a sheet thickness of 2.2 mm, and then subjected to hot band annealing at 1020° C. for 180 seconds. Subsequently, each steel sheet was subjected to cold rolling to an intermediate sheet thickness of 0.55 mm, and then to intermediate annealing under the following conditions: degree of oxidation $PH_2O/PH_2$=0.25, temperature=1050° C., and duration=90 seconds. Subsequently, each steel sheet was subjected to hydrochloric acid pickling to remove subscales from the surfaces thereof, followed by cold rolling again to be finished to a cold-rolled sheet having a sheet thickness of 0.23 mm.

TABLE 1

| Steel | Chemical Composition [mass %] (C, O, N, Al, Se and S: [mass ppm]) | | | | | | | | |
|---|---|---|---|---|---|---|---|---|---|
| ID | C | Si | Mn | Ni | O | N | Al | Se | S |
| A | 450 | 3.25 | 0.04 | 0.01 | 16 | 70 | 230 | tr | 20 |
| B | 550 | 3.30 | 0.11 | 0.01 | 15 | 25 | 30 | 100 | 30 |
| C | 700 | 3.20 | 0.09 | 0.01 | 12 | 80 | 200 | 90 | 30 |
| D | 250 | 3.05 | 0.04 | 0.01 | 25 | 40 | 60 | tr | 20 |

balance: Fe and incidental impurities

Thereafter, each steel sheet was applied with etching resist by gravure offset printing. Then, each steel sheet was subjected to electrolysis etching and resist stripping in an alkaline solution, whereby linear grooves, each having a width of 150 μm and depth of 20 μm were formed at intervals of 3 mm at an inclination angle of 10° relative to a direction perpendicular to the rolling direction.

Then, each steel sheet was subjected to decarburization where it was retained at a degree of oxidation $PH_2O/PH_2$=0.55 and a soaking temperature of 825° C. for 200 seconds. Then, an annealing separator composed mainly of MgO was applied to each steel sheet. At this moment, the amount of the annealing separator applied and the coiling tension after the application of the annealing separator were varied as shown in Table 2. Thereafter, each steel sheet was subjected to final annealing for the purposes of secondary recrystallization and purification under the conditions of 1250° C. and 10 hours in a mixed atmosphere of $N_2$:$H_2$=60:40. In this final annealing, end-point temperature was controlled to 1200° C., where gas flow rate at 900° C. or higher and average cooling rate during a cooling process at a temperature range of 700° C. or higher were changed. Additionally, each steel sheet was subjected to flattening annealing to correct the shape of the steel sheet, where it was retained at 830° C. for 30 seconds. Then, a tension coating composed of 50% of colloidal silica and magnesium phosphate was applied to each steel sheet to be finished to a product, for which magnetic properties and film tension were evaluated. Tension in the rolling direction was adjusted by changing the amount of tension coating applied. In addition, other products were also produced as comparative examples where grooves were formed by the above-mentioned method after final annealing. In this case, manufacturing conditions except groove formation timing were the same as described above. Then, each product was sheared into pieces of material having bevel edge to be assembled into a three-phase transformer at 500 kVA, and then measured for its iron loss in a state where it was excited at 50 Hz and 1.7 T. The above-mentioned measurement results on iron loss are shown in Table 2.

TABLE 2

| No. | Steel ID | Groove Formation Timing | Amount of Annealing Separator Applied ($g/m^2$) | Coiling Tension After Annealing Separator Applied ($N/mm^2$) | Cooling Rate to 700° C. (° C./h) | Gas Flow Rate at 900° C. or higher ($Nm^3/h \cdot ton$) | Thickness of Forsterite Film at Bottom Portions of Grooves (μm) | Groove Frequency (%) |
|---|---|---|---|---|---|---|---|---|
| 1 | A | After Cold Rolling | 13 | 25 | 25 | 0.8 | — | — |
| 2 | | After Cold Rolling | 7 | 50 | 30 | 1.0 | 0.5 | 0 |
| 3 | | After Cold Rolling | 11 | 50 | 30 | 1.0 | 0.5 | 0 |
| 4 | | After Cold Rolling | 11 | 50 | 30 | 2.6 | 0.1 | 0 |
| 5 | | After Final Annealing | 11 | 50 | 30 | 1.0 | 0 | 0 |
| 6 | | After Cold Rolling | 11 | 50 | 30 | 1.0 | 0.5 | 0 |
| 7 | | After Cold Rolling | 13 | 50 | 30 | 1.0 | 0.5 | 0 |
| 8 | B | After Cold Rolling | 12 | 80 | 100 | 0.8 | 0.7 | 0 |
| 9 | | After Cold Rolling | 12 | 80 | 60 | 0.8 | 0.7 | 0 |
| 10 | | After Cold Rolling | 12 | 80 | 40 | 0.8 | 0.7 | 0 |
| 11 | | After Cold Rolling | 12 | 80 | 40 | 0.8 | 0.7 | 0 |
| 12 | | After Final Annealing | 12 | 80 | 40 | 0.8 | 0 | 0 |
| 13 | | After Cold Rolling | 12 | 80 | 40 | 1.8 | 0.2 | 0 |
| 14 | | After Cold Rolling | 12 | 80 | 20 | 0.8 | 0.7 | 0 |
| 15 | | After Cold Rolling | 12 | 170 | 20 | 0.8 | 0.7 | 0 |
| 16 | | After Cold Rolling | 6 | 80 | 20 | 0.8 | 0.7 | 0 |
| 17 | C | After Cold Rolling | 15 | 120 | 3 | 0.6 | 0.8 | 0 |
| 18 | | After Cold Rolling | 15 | 120 | 45 | 0.6 | 0.8 | 0 |
| 19 | | After Cold Rolling | 15 | 120 | 45 | 2.1 | 0.15 | 0 |
| 20 | | After Cold Rolling | 15 | 120 | 45 | 0.6 | 0.8 | 0 |
| 21 | | After Cold Rolling | 15 | 200 | 45 | 0.6 | 0.8 | 0 |
| 22 | | After Cold Rolling | 15 | 200 | 80 | 0.6 | 0.8 | 0 |
| 23 | D | After Cold Rolling | 12 | 60 | 30 | 0.3 | 1.2 | 0 |
| 24 | | After Cold Rolling | 12 | 60 | 30 | 0.7 | 0.9 | 0 |
| 25 | | After Final Annealing | 12 | 170 | 30 | 0.7 | 0 | 0 |
| 26 | | After Cold Rolling | 12 | 170 | 30 | 2.1 | 0.15 | 0 |
| 27 | | After Cold Rolling | 8 | 250 | 30 | 0.5 | 0.9 | 0 |
| 28 | | After Cold Rolling | 8 | 300 | 100 | 0.5 | 0.9 | 0 |

TABLE 2-continued

| No. | Tension Applied to Steel Sheet: Tension in Rolling Direction (MPa) | Tension in Transverse Direction (MPa) | Rolling Direction Transverse Direction | Product $W_{17/50}$ (W/kg) | Transformer $W_{17/50}$ (W/kg) | Building Factor | Others | Remarks |
|---|---|---|---|---|---|---|---|---|
| 1 | — | — | — | — | — | — | uncoiling occurred, not available as a product | Comparative Example |
| 2 | 15 | 2.7 | 5.6 | 0.69 | 0.94 | 1.36 | — | Comparative Example |
| 3 | 15 | 7.5 | 2.0 | 0.69 | 0.83 | 1.20 | — | Inventive Example |
| 4 | 15 | 7.5 | 2.0 | 0.72 | 0.87 | 1.21 | — | Comparative Example |
| 5 | 15 | 7.5 | 2.0 | 0.73 | 0.88 | 1.21 | — | Comparative Example |
| 6 | 9 | 8.0 | 1.1 | 0.75 | 0.91 | 1.21 | — | Comparative Example |
| 7 | 15 | 6.2 | 2.4 | 0.69 | 0.83 | 1.20 | — | Inventive Example |
| 8 | 16 | 1.7 | 9.4 | 0.67 | 0.94 | 1.40 | — | Comparative Example |
| 9 | 16 | 2.5 | 6.4 | 0.67 | 0.95 | 1.42 | — | Comparative Example |
| 10 | 7 | 8.0 | 0.9 | 0.73 | 1.01 | 1.38 | — | Comparative Example |
| 11 | 18 | 8.0 | 2.3 | 0.67 | 0.82 | 1.22 | — | Inventive Example |
| 12 | 16 | 6.0 | 2.7 | 0.72 | 0.87 | 1.21 | — | Comparative Example |
| 13 | 16 | 6.0 | 2.7 | 0.71 | 0.86 | 1.21 | — | Comparative Example |
| 14 | 16 | 6.0 | 2.7 | 0.67 | 0.82 | 1.22 | — | Inventive Example |
| 15 | 16 | 2.8 | 5.7 | 0.67 | 0.95 | 1.42 | — | Comparative Example |
| 16 | 12 | 2.5 | 4.8 | 0.72 | 0.96 | 1.33 | — | Comparative Example |
| 17 | 16 | 6.5 | 2.5 | 0.65 | 0.79 | 1.22 | (low productivity) | Inventive Example |
| 18 | 16 | 6.5 | 2.5 | 0.65 | 0.79 | 1.22 | — | Inventive Example |
| 19 | 16 | 6.5 | 2.5 | 0.69 | 0.83 | 1.20 | — | Comparative Example |
| 20 | 35 | 6.5 | 5.4 | 0.62 | 0.87 | 1.40 | — | Comparative Example |
| 21 | 18 | 3.0 | 6.0 | 0.65 | 0.94 | 1.45 | — | Comparative Example |
| 22 | 18 | 1.8 | 10.0 | 0.65 | 0.97 | 1.49 | — | Comparative Example |
| 23 | 20 | 6.5 | 3.1 | 0.65 | 0.79 | 1.22 | — | Inventive Example |
| 24 | 20 | 6.8 | 2.9 | 0.66 | 0.80 | 1.21 | — | Inventive Example |
| 25 | 20 | 4.2 | 4.8 | 0.71 | 0.93 | 1.31 | — | Comparative Example |
| 26 | 20 | 4.2 | 4.8 | 0.70 | 0.92 | 1.31 | — | Comparative Example |
| 27 | 20 | 1.8 | 11.1 | 0.66 | 0.95 | 1.44 | — | Comparative Example |
| 28 | 20 | 1.2 | 16.7 | 0.66 | 1.03 | 1.56 | — | Comparative Example |

As shown in Table 2, when using a grain oriented electrical steel sheet subjected to magnetic domain refining treatment by forming grooves so that it has a tension within our range, deterioration in the building factor is inhibited and an extremely good iron loss property is obtained. However, when using a grain oriented electrical steel sheet departing from our range, it fails to provide low iron loss and deterioration in the building factor is observed as an actual transformer even if the steel sheet exhibits good material iron loss.

Example 2

Steel slabs having chemical compositions shown in Table 1 were subjected to the same procedure under the same conditions as Experiment 1 up to the cold rolling step. Thereafter, a surface of each steel sheet was locally pressed with projected rolls so that linear grooves, each having a width of 150 μm and depth of 20 μm, were formed at intervals of 3 mm at an inclination angle of 10° relative to a direction perpendicular to the rolling direction. Then, each steel sheet was subjected to decarburization where it was retained at a degree of oxidation $PH_2O/PH_2$ of 0.50 and a soaking temperature of 840° C. for 300 seconds. Then, an annealing separator composed mainly of MgO was applied to each steel sheet. At this moment, the amount of the annealing separator applied and the coiling tension after the application of the annealing separator were varied as shown in Table 3. Thereafter, each steel sheet was subjected to final annealing for the purposes of secondary recrystallization and purification under the conditions of 1230° C. and 100 hours in a mixed atmosphere of $N_2$:$H_2$=30:70.

In this final annealing, gas flow rate at 900° C. or higher, average cooling rate during a cooling process at a temperature range of 700° C. or higher, and end-point temperature were changed. Additionally, each steel sheet was subjected to flattening annealing to correct the shape of the steel sheet, where it was retained at 820° C. for 100 seconds. Then, tension coating composed of 50% of colloidal silica and magnesium phosphate was applied to each steel sheet to be finished to a product, for which magnetic properties and film tension were evaluated. Tension in the rolling direction was adjusted by changing the amount of tension coating applied. In addition, other products were also produced as comparative examples where grooves were formed by the above-mentioned method after final annealing. In this case, manufacturing conditions except groove formation timing were the same as described above. Then, each product was sheared into pieces of material having bevel edge to be assembled into a three-phase transformer at 500 kVA, and then measured for its iron loss in a state where it was excited at 50 Hz and 1.7 T. The above-mentioned measurement results on iron loss are shown in Table 3.

TABLE 3

| No | Steel ID | Groove Formation Timing | Amount of Annealing Separator Applied ($g/m^2$) | Coiling Tension After Annealing Separator Applied ($N/mm^2$) | Cooling Rate to 700° C. (° C./h) | Gas Flow Rate at 900° C. or higher ($Nm^3/h \cdot ton$) | End-point Temp at Final Annealing (° C.) | Thickness of Forsterite Film at Bottom Portions of Grooves (μm) | Groove Frequency (%) |
|---|---|---|---|---|---|---|---|---|---|
| 1 | A | After Cold Rolling | 14 | 15 | 20 | 0.7 | 1180 | — | — |
| 2 | | After Cold Rolling | 6 | 55 | 35 | 1.0 | 1180 | 0.5 | 15 |
| 3 | | After Cold Rolling | 12 | 55 | 35 | 1.0 | 1180 | 0.5 | 15 |
| 4 | | After Cold Rolling | 12 | 55 | 35 | 1.0 | 1120 | 0.5 | 60 |
| 5 | | After Cold Rolling | 12 | 55 | 35 | 2.4 | 1180 | 0.1 | 15 |
| 6 | | After Final Annealing | 12 | 55 | 35 | 1.0 | 1180 | 0.5 | 80 |
| 7 | | After Cold Rolling | 12 | 55 | 35 | 1.0 | 1180 | 0.5 | 15 |
| 8 | | After Cold Rolling | 14 | 55 | 35 | 1.0 | 1180 | 0.5 | 15 |
| 9 | B | After Cold Rolling | 13 | 85 | 110 | 0.7 | 1200 | 0.7 | 10 |
| 10 | | After Cold Rolling | 13 | 85 | 70 | 0.7 | 1200 | 0.7 | 10 |
| 11 | | After Cold Rolling | 13 | 85 | 45 | 0.7 | 1200 | 0.7 | 10 |
| 12 | | After Cold Rolling | 13 | 85 | 45 | 0.7 | 1200 | 0.7 | 10 |
| 13 | | After Cold Rolling | 13 | 85 | 45 | 0.7 | 1140 | 0.7 | 30 |
| 14 | | After Final Annealing | 13 | 85 | 45 | 0.7 | 1200 | 0.7 | 45 |
| 15 | | After Cold Rolling | 13 | 85 | 45 | 1.7 | 1200 | 0.2 | 10 |
| 16 | | After Cold Rolling | 13 | 85 | 25 | 0.7 | 1200 | 0.7 | 10 |
| 17 | | After Cold Rolling | 13 | 175 | 25 | 0.7 | 1200 | 0.7 | 10 |
| 18 | | After Cold Rolling | 5 | 85 | 25 | 0.7 | 1200 | 0.7 | 10 |
| 19 | C | After Cold Rolling | 16 | 115 | 2 | 0.6 | 1170 | 0.8 | 0 |
| 20 | | After Cold Rolling | 16 | 115 | 40 | 0.6 | 1170 | 0.8 | 0 |
| 21 | | After Cold Rolling | 16 | 115 | 40 | 0.6 | 1130 | 0.8 | 25 |
| 22 | | After Cold Rolling | 16 | 115 | 40 | 1.9 | 1170 | 0.15 | 0 |
| 23 | | After Final Annealing | 16 | 115 | 40 | 0.6 | 1170 | 0.8 | 30 |
| 24 | | After Cold Rolling | 16 | 115 | 40 | 0.6 | 1170 | 0.8 | 0 |
| 25 | | After Cold Rolling | 16 | 190 | 40 | 0.6 | 1170 | 0.8 | 0 |
| 26 | | After Cold Rolling | 16 | 190 | 80 | 0.6 | 1170 | 0.8 | 0 |
| 27 | D | After Cold Rolling | 13 | 65 | 25 | 0.3 | 1200 | 1.2 | 10 |
| 28 | | After Cold Rolling | 13 | 65 | 25 | 0.5 | 1200 | 0.9 | 10 |
| 29 | | After Cold Rolling | 13 | 65 | 25 | 0.5 | 1130 | 0.9 | 40 |
| 30 | | After Final Annealing | 13 | 165 | 25 | 0.5 | 1200 | 0.9 | 60 |
| 31 | | After Cold Rolling | 13 | 165 | 25 | 1.9 | 1200 | 0.15 | 12 |
| 32 | | After Cold Rolling | 7 | 260 | 25 | 0.5 | 1200 | 0.9 | 12 |
| 33 | | After Cold Rolling | 7 | 320 | 95 | 0.5 | 1200 | 0.9 | 12 |

| No | Tension Applied to Steel Sheet: Tension in Rolling Direction (MPa) | Tension Applied to Steel Sheet: Tension in Transverse Direction (MPa) | Rolling Direction Transverse Direction | Product $W_{17/50}$ (W/kg) | Trans-former $W_{17/50}$ (W/kg) | Building factor | Others | Remarks |
|---|---|---|---|---|---|---|---|---|
| 1 | — | — | — | — | — | — | uncoiling occured not available as a product | Comparative Example |
| 2 | 14 | 2.5 | 5.6 | 0.67 | 0.93 | 1.39 | — | Comparative Example |
| 3 | 14 | 7.3 | 1.9 | 0.67 | 0.81 | 1.21 | — | Inventive Example |
| 4 | 14 | 7.3 | 1.9 | 0.65 | 0.85 | 1.31 | — | Comparative Example |
| 5 | 14 | 7.3 | 1.9 | 0.70 | 0.85 | 1.21 | — | Comparative Example |
| 6 | 14 | 7.3 | 1.9 | 0.65 | 0.84 | 1.29 | — | Comparative Example |
| 7 | 8 | 7.5 | 1.1 | 0.73 | 0.89 | 1.22 | — | Comparative Example |
| 8 | 14 | 6.3 | 2.2 | 0.67 | 0.81 | 1.21 | — | Inventive Example |
| 9 | 15 | 1.8 | 8.3 | 0.69 | 0.96 | 1.39 | — | Comparative Example |
| 10 | 15 | 2.7 | 5.6 | 0.69 | 0.97 | 1.41 | — | Comparative Example |
| 11 | 6 | 8.0 | 0.8 | 0.75 | 1.03 | 1.37 | — | Comparative Example |
| 12 | 17 | 8.0 | 2.1 | 0.69 | 0.84 | 1.22 | — | Inventive Example |
| 13 | 15 | 8.0 | 1.9 | 0.68 | 0.89 | 1.31 | — | Comparative Example |
| 14 | 15 | 6.5 | 2.3 | 0.68 | 0.88 | 1.29 | — | Comparative Example |
| 15 | 15 | 6.5 | 2.3 | 0.73 | 0.88 | 1.21 | — | Comparative Example |
| 16 | 15 | 6.0 | 2.5 | 0.69 | 0.84 | 1.22 | — | Inventive Example |
| 17 | 15 | 3.0 | 5.0 | 0.69 | 0.97 | 1.41 | — | Comparative Example |
| 18 | 12 | 2.5 | 4.8 | 0.74 | 0.98 | 1.32 | — | Comparative Example |
| 19 | 15 | 6.0 | 2.5 | 0.66 | 0.80 | 1.21 | (low productivity) | Inventive Example |
| 20 | 15 | 6.0 | 2.5 | 0.66 | 0.80 | 1.21 | — | Inventive Example |
| 21 | 15 | 6.0 | 2.5 | 0.65 | 0.84 | 1.29 | — | Comparative Example |
| 22 | 15 | 6.0 | 2.5 | 0.70 | 0.84 | 1.20 | — | Comparative Example |
| 23 | 15 | 6.0 | 2.5 | 0.65 | 0.84 | 1.29 | — | Comparative Example |
| 24 | 30 | 6.0 | 5.0 | 0.63 | 0.88 | 1.40 | — | Comparative Example |
| 25 | 17 | 2.2 | 7.7 | 0.66 | 0.95 | 1.44 | — | Comparative Example |
| 26 | 19 | 1.2 | 15.8 | 0.66 | 0.98 | 1.48 | — | Comparative Example |
| 27 | 21 | 6.5 | 3.2 | 0.66 | 0.79 | 1.20 | — | Inventive Example |
| 28 | 21 | 6.5 | 3.2 | 0.67 | 0.80 | 1.19 | — | Inventive Example |
| 29 | 21 | 6.5 | 3.2 | 0.65 | 0.85 | 1.31 | — | Comparative Example |
| 30 | 21 | 6.5 | 3.2 | 0.65 | 0.84 | 1.29 | — | Comparative Example |

TABLE 3-continued

| | | | | | | | | |
|---|---|---|---|---|---|---|---|---|
| 31 | 21 | 4.5 | 4.7 | 0.71 | 0.92 | 1.30 | — | Comparative Example |
| 32 | 21 | 1.8 | 11.7 | 0.67 | 0.95 | 1.42 | — | Comparative Example |
| 33 | 21 | 1.2 | 17.5 | 0.67 | 1.03 | 1.54 | — | Comparative Example |

As shown in Table 3, each grain oriented electrical steel sheet subjected to magnetic domain refining treatment by forming grooves so that it has a tension within our range is less susceptible to deterioration in its building factor and offers extremely good iron loss properties. In contrast, each grain oriented electrical steel sheet departing from our range fails to provide low iron loss properties and suffers deterioration in its building factor as an actual transformer, even if it exhibits good iron loss properties as a material.

The invention claimed is:

1. A grain oriented electrical steel sheet comprising: a forsterite film, tension coating on a surface of the steel sheet; and grooves for magnetic domain refinement on the surface of the steel sheet, wherein 1) a thickness of the forsterite film at bottom portions of the grooves is 0.3 μm or more, 2) groove frequency is 20% or less, the groove frequency being a ratio of the number of grooves, each groove having crystal grains directly beneath itself, each crystal grain having an orientation deviating from a Goss orientation by 10° or more and a grain size of 5 μm or more to the number of all grooves, and 3) total tension exerted on the steel sheet in a rolling direction by the forsterite film and the tension coating is 10.0 MPa or more, a total tension exerted on the steel sheet in a direction perpendicular to the rolling direction by the forsterite film and the tension coating is 5.0 MPa or more, and total tensions satisfy:

$$1.0 \leq A/B \leq 5.0,$$

where

A is total tension exerted in the rolling direction by the forsterite film and the tension coating, and B is total tension exerted in a direction perpendicular to the rolling direction by the forsterite film and the tension coating.

* * * * *